United States Patent [19]

van der Tak

[11] Patent Number: 4,838,193

[45] Date of Patent: Jun. 13, 1989

[54] SCRUBBING MACHINE

[76] Inventor: Josephus A. M. van der Tak, Wassenaarseweg 47, 2596 CG The Hague, Netherlands

[21] Appl. No.: 137,177

[22] Filed: Dec. 23, 1987

[30] Foreign Application Priority Data

Dec. 23, 1986 [NL] Netherlands ..... 8603270

[51] Int. Cl.[4] ..... B63B 59/06

[52] U.S. Cl. ..... 114/222; 15/49 R

[58] Field of Search ..... 114/222; 15/1.7, 28, 15/29, 50 R, 180

[56] References Cited

U.S. PATENT DOCUMENTS 3,609,916 10/1971 Hammelmann ..... 114/222
3,773,059 11/1973 Arneson ..... 114/222
3,906,572 9/1975 Winn ..... 114/222
4,084,535 4/1978 Rees ..... 114/222
4,314,521 2/1982 Lundberg ..... 114/222

FOREIGN PATENT DOCUMENTS 2131288 6/1984 United Kingdom ..... 114/222

*Primary Examiner*—Sherman D. Basinger
*Assistant Examiner*—Stephen P. Avila
*Attorney, Agent, or Firm*—Limbach, Limbach & Sutton

[57] ABSTRACT

A scrubbing machine is disclosed which is particularly useful for cleaning the hull of a ship below the waterline. The scrubbing machine includes rotary brushes driven by a single pump motor that also functions to create suction in a closed brush control circuit. The scrubbing machine also includes adjustable spacers that help provide efficient cleaning action.

2 Claims, 2 Drawing Sheets

SCRUBBING MACHINE

TECHNICAL FIELD

This invention relates to a scrubbing machine comprising a holder supporting at least one rotary brush, and a drive to rotate said brush(es), a positive pressure being applied on said drive through a control line, and suction force being provided to suck said brush(es) onto a surface to be brushed.

BACKGROUND OF THE INVENTION

Such a scrubbing machine is known from Dutch patent application No. 8501089. The prior art scrubbing machine has several disadvantages. For instance, when the brushes are too strongly depressed due to the suction created by rotation, the brush rotation is much retarded so that the scrubbing action is reduced. Conversely, under a fast brush rotation, the depression and scrubbing action is too slight and there are no means present to effectively control this interaction when brushing.

SUMMARY OF THE INVENTION

Accordingly, it is an object of the present invention to eliminate the disadvantages of the prior art scrubbing machine. This is accomplished by the use of adjustable spacer means, in the form of mounting, sliding or running means such as rollers or wheels, which are connected with the brush(es) to control brush depression under said suction force. The brush(es) can thus be firmly depressed and, yet without too strong a braking action, can be rotated so that the brushing action will always be properly effected without any interference. The brush pressure should be sufficient but not too strong so as to retard the brush rotation too much for proper operation.

The scrubbing machine known from said Dutch patent application No. 8501089 has flotation-cushions but no adjustable spacer means to effectively control the brushing action. It is also preferable to suck about the brush, not through it, so as to avoid the accumulation of brushed-off matter within the brush. In this way, brushed-off matter is drawn from the brush so that the brush keeps clean and can properly exert its action for a longer period of time. According to the present invention, the requirement in order for a brush to suck itself onto a surface to be scrubbed is that its rotation field be intersected by said surface so that a centripetal suction force vector normal thereto is created, which is especially obtained when a brush has its axis of rotation not strictly normal but inclinedly directed on the surface to be scrubbed or parallel thereto.

In the preferred embodiment of the present invention, said pressure on said drive is applied through a hydraulic pressure vessel which is controlled by a pneumatic pump with pressure limitation to maintain the pressure level.

In an alternative embodiment of the instant scrubbing machine, the control line has a pump connected therein. Both the pressure and the suction sides of the pump may be connected to the scrubbing machine so that both pressurizing and suction takes place through the control line. A filter is connected upstream of the pump. The filter preferably comprises a filtrate reservoir, particularly an exchangeable filter bag, in view of environmental protection. When sufficient filtrate, i.e. material that is filtered out of the flow medium, is accumulated in the bag, the bag is removed from the line and replaced by an empty bag and the filtrate is disposed of.

A foul collector vessel is known from French Pat. No. 2534584 but does not comprise a filter bag to be connected to a filter.

An efficient arrangement is further accomplished by connecting a reservoir to the pump, which is adapted to further act on the control line when the pump is switched off by syphon action. Additionally, the reservoir is adapted to be replenished or, when in an arrangement as a hydraulic pressure vessel, to be pressurized by the pump. The pump is switched off and on by pressure sensors at a predetermined high, and low pressure limit, respectively, for continuous operation.

In a particularly suitable embodiment, one central suction unit drives a plurality of brushes mounted about it, and the drive of the wheels is also derived from the central unit. Thus, in a single operation, a very large surface such as the sheel plating of a large ship, can be brushed clean.

Running rollers are known from U.S. Pat. No. 4,052,950; however, the adjustability of the brushes with respect to such running rollers in view of an optimum brushing action is not suggested therein.

The invention is further described in the following detailed description taken in conjunction with the drawings.

DETAILED DESCRIPTION OF THE PREFERRED EMBODIMENTS

Figure 1:
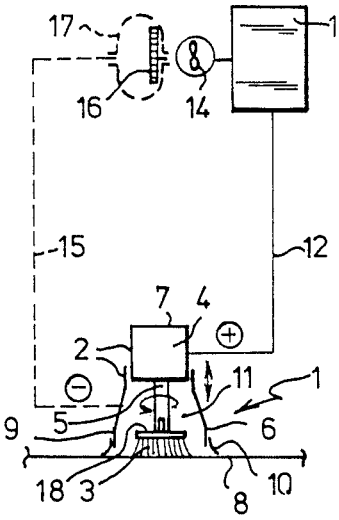
FIG. 1 shows a working scheme of the scrubbing machine according to the present invention.

Referring now to FIG. 1, the scrubbing machine 1 is provided with a holder 2 in which a brush 3 having a drive 4 to rotate the brush 3 is arranged. The rotary brush shaft is indicated at 5.

The holder 2 has a telescopic part 6 which functions as a spacer means and is longitudinally movable on a casing 7 of the drive 4 as indicated by the twin arrow in FIG. 1. The telescopic part 6 can be placed in a desired position so as to obtain a predetermined brush depression onto a surface 8 to be brushed, and is then to be secured on the casing 7.

A drag seal 10 is provided around a holder edge 9 in order to hold the scrubbing machine 1 onto the surface 8 to be brushed, while producing, in a manner to be described in more detail, a vacuum pressure within the holder part 6 to suck the machine 1 onto the surface 8 to be brushed. Due to the adjustability of the telescopic holder part 6 with respect to the casing 7, with the rotary shaft 5 mounted thereon and the rotary brush 3 seated thereon, the brush hairs project beyond the holder the distance required for a predetermined brush depression, said drag seal 10 also being well depressed onto the surface 8 to seal a suction chamber 11 which is formed within the holder part 6. It should be noted however, that the depression of the drag seal 10 and the brush 3 should not be so strong that the drag seal 10 and brush 3 would not be smoothly movable along the surface 8. In spite of its sealing pressure onto the surface 8, the drag seal should nevertheless allow the scrubbing machine 1 to smoothly move along said surface 8 and the depression of brush 3 should be firm enough to properly brush the surface 8, but should not be so strong so as to retard brush rotation. The telescopic positioning of the holder part 6 on the casing 7 should thus be finely adjustable and easily effected, for example by means of screwthread with a fine pitch, in order to permit proper control of the relative adjustment of the brush 3 and the seal 10.

In the working scheme of FIG. 1, the drive 4 is controlled by pressure through a line 12, as indicated with a plus sign, which is supplied by a hydraulic pressure vessel or, in more general terms, by a pressure reservoir 13 to which a pump 14 is connected with its pressure side. The pump 14 is adapted to be connected with its suction side through a suction line 15 to the suction chamber 11 which is formed within the holder 2, as indicated in dotted lines in FIG. 1. This produces the required vacuum pressure therein as already stated in the foregoing, and the brushed-off material which is accumulated within the holder 2 wll be sucked therefrom and discharged through the suction line 15.

A filter 16 with its filter reservoir 17 in which brushed-off material can be accumulated, is connected to the suction line 15 upstream of the pump 14. The filter reservoir 17 preferably comprises a filter bag which is removable from line 15 and which when filled, can be detached and replaced by an empty bag, so that the filtrated brushed-off material can be disposed of and without polluting the environment.

Figure 4:
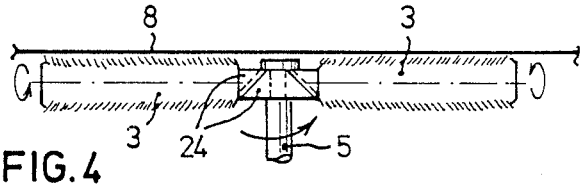
FIG. 4 schematically shows, in longitudinal section, a drive comprising bevel gears, and a system of brush rolls, each to be rotated about the axis of the system as well as about their own axis so as to selfprovide the suction force to be sucked onto the surface to be brushed in their action.

The suction for the attachment of the brush 3 to the surface 8 to be brushed can also be produced or enhanced efficiently by a rotary brush which has a rotation force component in the direction of this surface 8, such as the rotary brushes 3 shown in FIG. 4, which draw themselves onto the surface 8. This is because the surface 8 intersects a force field, or more correctly termed, cuts it off so as to produce a centripetal force vector drawing the brush 3 and the surface 8 to one another.

It is important to note that although in FIG. 1 the spacer means controlling the brush depression is depicted as a cylinder or sleeve 6 which is telescoped on the casing 7, positioning legs, or rolling elements such as rollers or wheels could also be used for spacer means, particularly in a case where no sealed suction chamber needs to be used when the brushes themselves are capable of providing the suction force like the brushes 3 shown in FIG. 4.

In all cases it is desirable that no suction is applied through the brush 3 from the suction chamber, but that the brushed-off material is sucked around it so as not to accumulate in the brush and interfere with its proper action. To that end, the brush 3 in FIGS. 1 and 2 has a closed brush bottom 18 through which no suction can be applied, so that no brushed-off material will be drawn into the brush 3. The material will rather be sucked away around the brush 3 for its discharge through the suction line 15 which as indicated by a minus sign will act on the suction chamber 11.

Figure 2:
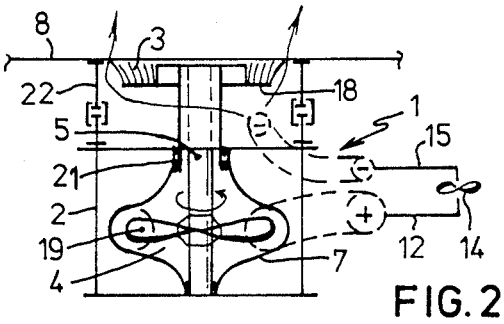
FIG. 2 is a view, in longitudinal section and drawn to a larger scale, of the holder, with the brush and brush drive arranged therein.

FIG. 2 shows a more detailed view of the brush holder 2 and of the drive 4 mounted therein, which as shown comprises an impeller motor. It is preferred that the impeller 19 has its impeller blades 20 inclined in the onflow direction in cross section so as to apply a suction for the attachment of the brush to the surface 8 to be scrubbed through apertures 21 in the impeller casing 7, which are here only schematically represented. This suction is here not applied through the brush 3 due to a closed brush bottom plate 18. This avoids accumulation of brushed-off material in the brush 3, but has its effect around the brush 3.

Figure 3:
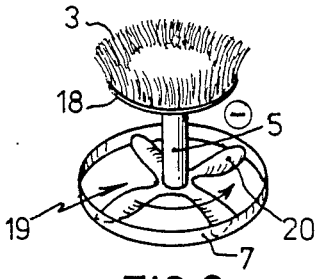
FIG. 3 is a perspective view of an impeller motor functioning as a drive of the brush, and having in cross-section in the onflow direction, inclined impeller blades to produce suction force to suck the brush onto a surface to be brushed.

FIG. 3 is a perspective view of such an impeller 19 with inclined impeller blades 20. The impeller 19 could also have multiple flights in a staged embodiment in which the impeller casing 7 could also comprise a volute as every impeller pump may have.

Figure 7:
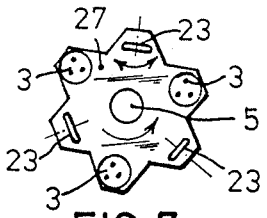
FIGS. 7 and 8 show, in plan view, a brush set mounted on a working platform comprising, as represented, three brushes with alternately arranged spacer means in the form of running wheels.

In FIG. 2 positioning legs are used for the spacing means to maintain the desired brush pressure whereas in FIG. 7 running wheels are used to that end as will be described in more detail hereafter.

The drive 4 shown in FIG. 4 comprises bevel gears 24 to drive a set of brush rolls 3 which, due to the fact that their rotation force field is normal to the surface 8 to be scrubbed, are capable of providing their own suction onto said surface 8, as already explained in the foregoing.

Figure 5:
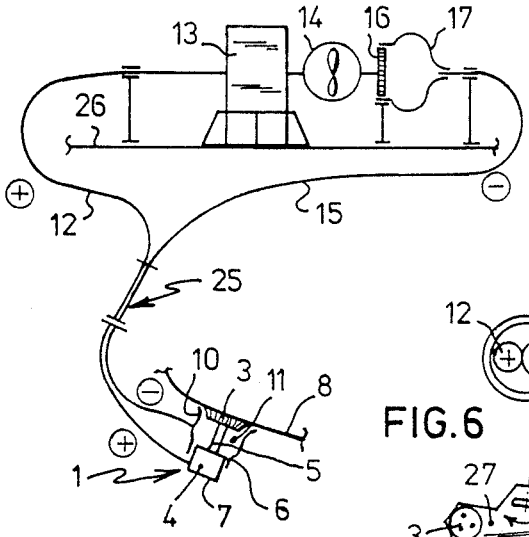
FIG. 5 is a schematic view of a pressure reservoir or hydraulic pressure vessel with its pump unit which can also be installed at a distance from the scrubbing machine, for example on deck of a boat, to permit underwater brushing of the hull of a ship so as to remove algae and other growth from the hull, which view also shows the dual operating line comprising a pressure and a suction line to drive the brush and to suck it onto the surface to be scrubbed and to discharge the brushed-off material.

FIG. 5 schematically shows the arrangement of a hydraulic pressure vessel, or more generally termed a pressure reservoir 13, controlling the drive 4 through a pressure line 12 which in its preferred form is embodied as a fall tube for additional dynamic pressure. Its pump 14, as described hereabove, preferably has a pump filter 16 with a filter reservoir 17 connected upstream thereto in the suction line 15 which is connected to the scrubbing machine 1.

Figure 6:
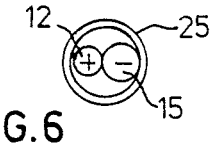
FIG. 6 is a cross sectonal view, to a larger scale, of the dual operating line of the present scrubbing machine.

FIG. 6 shows a dual operating line comprising the pressure line 12 and the suction line 15 in cross section at the location in the line where the two line parts 12 and 15 extend in joined connection as a twin operating hose 25.

The above described unit 13–17, providing pressure and suction, may be arranged on a deck 26 of a boat when a large scrubbing machine would operate on the hull of a ship underwater. In this arrangement, the hose 25 leads to the scrubbing machine 1 preferably comprising a plurality of brushes 3 as shown in FIG. 7 which are mounted on a working platform 27 in an alternating arrangement with running wheels 23 mounted inbetween on said working platform 27, to function as spacer means. In this way, the scrubbing machine 1 can easily be manoeuvered over the surface 8 to be brushed, by a diver who is in charge of the brushing activities. In this case the fluid driving the machine 1, consists of a liquid such as water. Also, a closed oil-hydraulic control circuit could be used as well as a pneumatic circuit using a gas such as air. It should be noted that the wheels 23 may comprise both fixed and castor wheels.

The hydraulic pressure vessel can be kept pressurized by a fill pump havng its working range limited by pressure sensors. Level sensors in an interface present in the pressure reservoir could also be used to limit the working range of the pump.

Finally, it is to be understood that still further embodiments of the present invention would be possible. For instance, instead of brushing or scrubbing, cleansing or painting with a controlled dropwise paint supply to the brush could be involved.

Figure 8:
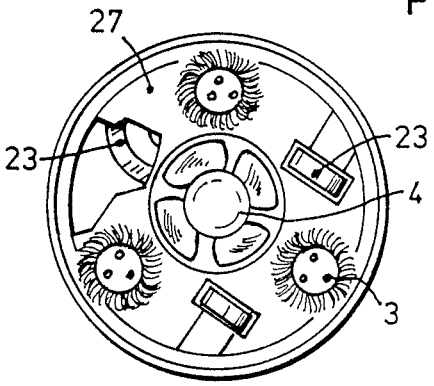

FIG. 8 shows an embodiment with one central suction unit 4 driving a plurality of brushes 3 mounted thereabout on a working platform 27. Also, the drive of the wheels 23 is taken off said suction unit, one of said wheels being represented as a castor or steering wheel. This possibility could most suitably be applied in a flat embodiment, to brush the bottom of the hull of a ship with the suction unit operating at a small distance below the hull so as to remove and dispose of the growth from the ship in an efficient manner.

It should be understood that while the subject invention has been disclosed with reference to the above embodiments, various alternatives to the structures herein may be employed in practicing the present invention. It is intended that the following claims define the invention and that the structure within the scope of these claims and their equivalents be covered thereby.

I claim:

1. A scrubbing machine comprising:

a holder carrying at least one rotary brush;

a drive means for rotating said one brush;

a single control means for controlling said drive means and for applying suction force to suck said brush onto a surface to be brushed, whereby the scrubbing machine is operated by said single control means;

adjustable spacer means in association with said brush to control brush depression under said suction force;

a control line connected to said control means and further wherein said control means comprises a single pump having a pressure side and a suction side, each connected into said control line in a closed control circuit;

a reservoir connected to said pump, said reservoir adapted to act on said control line when said pump is switched off by syphon action and wherein said reservoir is adapted to be replenished or pressurized by said pump; and pressure sensors to act on said pump at a predetermined high and low pressure limit, to switch said pump off and on, respectively.

2. The scrubbing machine, according to claim 1, further comprising a central unit driving a plurality of brushes mounted about said central unit; and wherein said adjustable spacer means comprises roller elements driven by said drive means.

* * * * *